US009181766B2

(12) United States Patent
Leahy et al.

(10) Patent No.: US 9,181,766 B2
(45) Date of Patent: Nov. 10, 2015

(54) BREAKOUT TOOL

(75) Inventors: Matthew K. Leahy, Canning Vale (AU); Tomas Borg, Canning Vale (AU)

(73) Assignee: Metzke Pty. Ltd., Canning Vale (AU)

( * ) Notice: Subject to any disclaimer, the term of this patent is extended or adjusted under 35 U.S.C. 154(b) by 432 days.

(21) Appl. No.: 13/698,722

(22) PCT Filed: May 12, 2011

(86) PCT No.: PCT/AU2011/000554
§ 371 (c)(1),
(2), (4) Date: Jan. 29, 2013

(87) PCT Pub. No.: WO2011/143691
PCT Pub. Date: Nov. 24, 2011

(65) Prior Publication Data

US 2013/0118316 A1 May 16, 2013

(30) Foreign Application Priority Data

May 19, 2010 (AU) ..... 2010902190

(51) Int. Cl.
*E21B 19/16* (2006.01)

(52) U.S. Cl.
CPC ..... *E21B 19/16* (2013.01); *E21B 19/163* (2013.01)

(58) Field of Classification Search
CPC ..... E21B 19/16; E21B 19/163; E21B 19/18; B25B 13/50
USPC ..... 81/57.19, 57.44
See application file for complete search history.

(56) References Cited

U.S. PATENT DOCUMENTS

| | | | | |
|---|---|---|---|---|
| 2,823,450 | A * | 2/1958 | Thomas | 29/240 |
| 3,500,708 | A * | 3/1970 | Wilson | 81/57.34 |
| 4,072,434 | A * | 2/1978 | Homuth | 403/263 |
| 4,194,419 | A | 3/1980 | Mitchhart | |
| 5,040,438 | A * | 8/1991 | Rousseau | 81/57.35 |
| 5,537,900 | A * | 7/1996 | Schaar | 81/57.33 |
| 5,653,297 | A | 8/1997 | Whisehunt | |
| 5,791,206 | A * | 8/1998 | Daigle et al. | 81/57.33 |
| 5,931,231 | A * | 8/1999 | Mock | 166/377 |
| 6,012,360 | A * | 1/2000 | Concha | 81/57.39 |
| 6,047,775 | A | 4/2000 | Mock | |
| 7,707,914 | B2 * | 5/2010 | Pietras et al. | 81/57.16 |
| 8,453,542 | B2 * | 6/2013 | Gouws | 81/57.2 |
| 8,627,748 | B2 * | 1/2014 | Gouws | 81/57.19 |
| 2011/0138969 | A1 * | 6/2011 | Gouws | 81/57.33 |

OTHER PUBLICATIONS

Australian International Search Report mailed Jul. 6, 2011.

* cited by examiner

*Primary Examiner* — David B Thomas
(74) *Attorney, Agent, or Firm* — Nixon & Vanderhye P.C.

(57) ABSTRACT

A breakout tool including a breakout tong adapted to grip a first one of the two components of a drill string. The breakout tool can be used for breaking out the two components of a drill string while a second one of the two components is held stationary. The breakout tong includes a first jaw and a second jaw, with the second jaw pivotally coupled to the first jaw at a first pivot point. A small hydraulic cylinder is provided in the breakout tong for forcing the second jaw to pivot about the first pivot point when it is activated wherein, in use, the first drill string component can be gripped between the second jaw and the first jaw. A main hydraulic cylinder is adapted to be mounted on the drill rig, and which is mechanically coupled to the breakout tong for applying a torque to the breakout tong. In use, the two components of the drill string can be broken apart by the breakout tong gripping the first drill string component and applying a torque thereto via the main hydraulic cylinder.

15 Claims, 2 Drawing Sheets

BREAKOUT TOOL

FIELD OF THE INVENTION

The present invention relates to a tool for a drill rig and relates more particularly to a breakout tool for "breaking out" the components of a drill string.

BACKGROUND TO THE INVENTION

Virtually all types of drill rigs whether drilling for water, oil and gas, minerals or civil works and construction use drill rods and components that couple together to form a "drill string". The drill hole is normally progressed by applying a rotation and a downward force to the drill bit at the bottom of the drill string. The drill string typically consists of drill rods, drill bits, stabilisers, "subs" and many other components which are normally all of a tubular form and connect with male and female threads. The threads are usually an integral part of each component and are required to withstand all the tensile, compressive and torque forces that are applied to the drill string by the drill rig. As the drill hole progresses more components are added to the drill string until the final borehole depth is achieved.

To give strength to the coupling or "joint", and to avoid loosening while drilling, the joints in the drill string are often "made up" to a predetermined torque, and sometimes may become even tighter because of drilling conditions. When the drill string needs to be retrieved from the hole, the drill rods and components are removed by gradually withdrawing the drill string from the hole until (usually) one component at a time is exposed. The component below the one to be removed is held securely, allowing the upper component to be unscrewed and removed from the drill area. This cycle continues until all components are retrieved from the hole.

Unscrewing components of the drill string is often called "breaking out" the components. This is normally achieved with reverse rotation of the drill rig "rotation head" or "rotation gearbox". If the drill string has been over-tightened or if the drill rig head is not capable of breaking the joint, then extra assistance to break the joint is required. When this occurs a "breakout tool" is used to break or loosen the joint. The breakout tool usually consists of a holding "tong" which grips the drill string component, and a means of rotating the tong about the drill string centre. Currently in the industry various types of tong are used to grip the components including wrap-around chain type, pipe wrench type and other clamping designs. Many types of tongs are self-tightening, so that once they gain a minimal grip on the component they will progressively grip tighter as torque is applied. These prior art tools are generally attached to a hydraulic cylinder pulling tangentially to the drill string axis to essentially give a rotating force to the tong and subsequently the drill string component.

In the mineral exploration and water well drilling industry, breakout tools are used regularly. Existing breakout units have often been made from modified pipe wrenches attached to hydraulic cylinders, and there are many such ad hoc arrangements in use. The components in the drill string vary in diameter so the breakout tools need to be capable of gripping a range of diameters. Prior art breakout tools are usually manually adjusted to the component size, or parts of them exchanged to change the gripping size. The breakout tools are also manually applied to the drill string by a worker and often have to be supported by hand until load is applied and they begin to grip the component.

There are considerable forces involved in the breaking process, often up to several tonnes of pull required from the hydraulic cylinder. As many breakout tools are adapted from tools not designed or rated to handle these forces, failures do occur. The act of manually adjusting and applying most types of prior art breakout tools exposes workers to severe hazards as they work in close proximity to the breakout tool. There are many injuries associated with the use of traditional type breakout tools.

The present invention was developed with a view to providing a breakout tool that can be readily adjusted and applied to drill string components without exposing workers to unacceptable safety hazards.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a breakout tool for "breaking out" two components of a drill string, the tool comprising:

a breakout tong adapted to grip a first one of the two components of the drill string whilst a second one of the two components is held stationary, the breakout tong comprising a first jaw and a second jaw, the second jaw being pivotally coupled to the first jaw at a first pivot point and having a small hydraulic cylinder for forcing the second jaw to pivot about the first pivot point when it is activated wherein, in use, the first drill string component can be gripped between the second jaw and the first jaw; and, a main hydraulic cylinder adapted to be mounted on the drill rig and being mechanically coupled to the breakout tong for applying a torque to the breakout tong wherein, in use, the two components of the drill string can be broken apart by the breakout tong gripping the first drill string component and applying a torque thereto.

Preferably the small hydraulic cylinder has one end pivotally attached to the first jaw and the other end pivotally attached to the second jaw at a second pivot point located a predetermined distance from the first pivot point, for providing a required leverage when forcing the second jaw to pivot about the first pivot point. Advantageously the geometry of the second jaw relative to the first jaw of the breakout tong is such that, once the first jaw begins to grip the first drill string component, the greater the torque applied to the breakout tong the tighter the second jaw will grip the first drill string component.

Preferably the breakout tong is pivotally coupled to the main hydraulic cylinder via a first mounting clevis, the first mounting clevis being fixed to one end of the hydraulic cylinder and having a first pivot pin provided in connection therewith, the first pivot pin also passing through a mounting block provided in connection with the first jaw of the breakout tong.

Advantageously the mounting block is a swivel block which is adapted to permit the breakout tong to swivel though at least 180° wherein, in use, the orientation of the breakout tong can be changed to apply a torque to a component of the drill string in the opposite direction (in a makeup mode).

Preferably the main hydraulic cylinder is housed within an elongate square section housing. Advantageously a rod end of the main hydraulic cylinder is attached to a closed end of the housing, and a body of the main hydraulic cylinder is encased in a square section which enables it to slide longitudinally within the housing but without allowing any axial rotation.

Preferably the tool further comprises a plurality of hydraulic control valves for controlling the sequence of actuation of the small hydraulic cylinder and the main hydraulic cylinder. Preferably the plurality of hydraulic control valves comprises a small directional hydraulic valve and two sequence valves for ensuring the breakout tong grips before a torque is applied thereto, and releases before resetting in both a breakout mode and a makeup mode.

According to another aspect of the present invention there is provided a method of "breaking out" two components of a drill string using a breakout tool, the method comprising the steps of:

gripping a first one of the two components of the drill string with a breakout tong whilst the second one of the two components is held stationary, the breakout tong comprising a first jaw and a second jaw, the second jaw being pivotally coupled to the first jaw at a pivot point, the step of gripping comprising activating a small hydraulic cylinder for forcing the second jaw to pivot about the pivot point wherein, in use, the first drill string component is gripped between the second jaw and the first jaw; and, applying a torque to the breakout tong by activating a main hydraulic cylinder mounted on the drill rig and which is mechanically coupled to the breakout tong wherein, in use, the two components of the drill string can be broken apart as the breakout tong grips the first drill string component and applies a torque thereto.

Preferably the step of gripping the first drill string component comprises extending the main hydraulic cylinder to its maximum reach; retracting the small hydraulic cylinder open the first and second jaws of the breakout tong; positioning the first drill component between the first and second jaws; and, extending the small hydraulic cylinder to close the first and second jaws about the first drill string component.

Preferably the step of applying a torque to the breakout tong comprises retracting the main hydraulic cylinder until the joint between the two components of a drill string is "broken."

Advantageously the sequence of activating the small hydraulic cylinder for gripping the first drill string component and of activating the main hydraulic cylinder for applying a torque to the breakout tong is controlled via a plurality of hydraulic control valves wherein, in use, only a single hydraulic control signal is required to complete all phases of the breakout process.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of a preferred embodiment of the breakout tool and a method of "breaking out" two components of a drill string, given by way of example only, with reference to the accompanying drawings, in which.

DETAILED DESCRIPTION OF PREFERRED EMBODIMENTS

Figure 1:
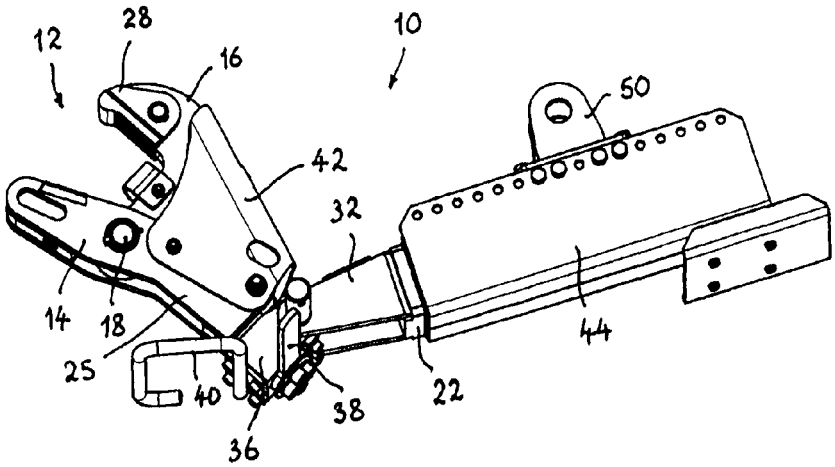
FIG. 1 is a top perspective view of a preferred embodiment of a breakout tool according to the present invention showing the tong in a first orientation.
Figure 2:
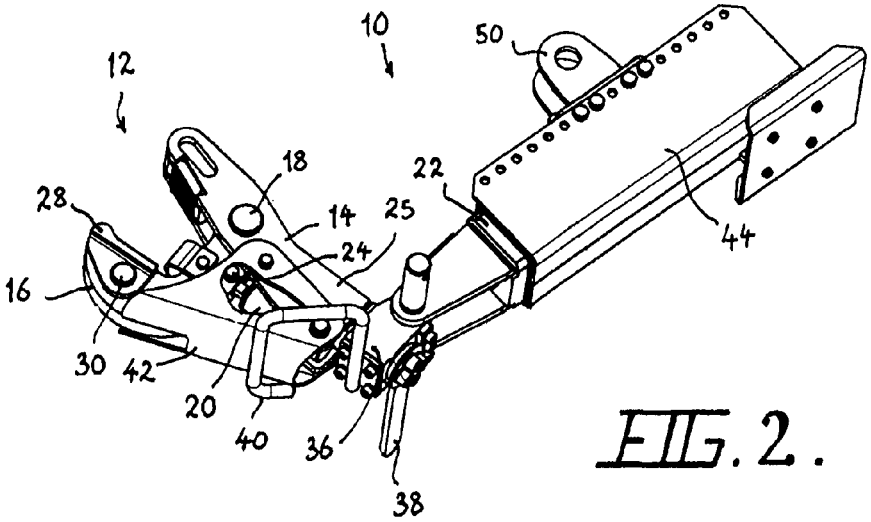
FIG. 2 is a top perspective view of the breakout tool of FIG. 1 showing the tong in a second orientation rotated 180° from the first orientation; and, FIG. 3 is a bottom perspective view of the breakout tool of FIG. 1.
Figure 3:
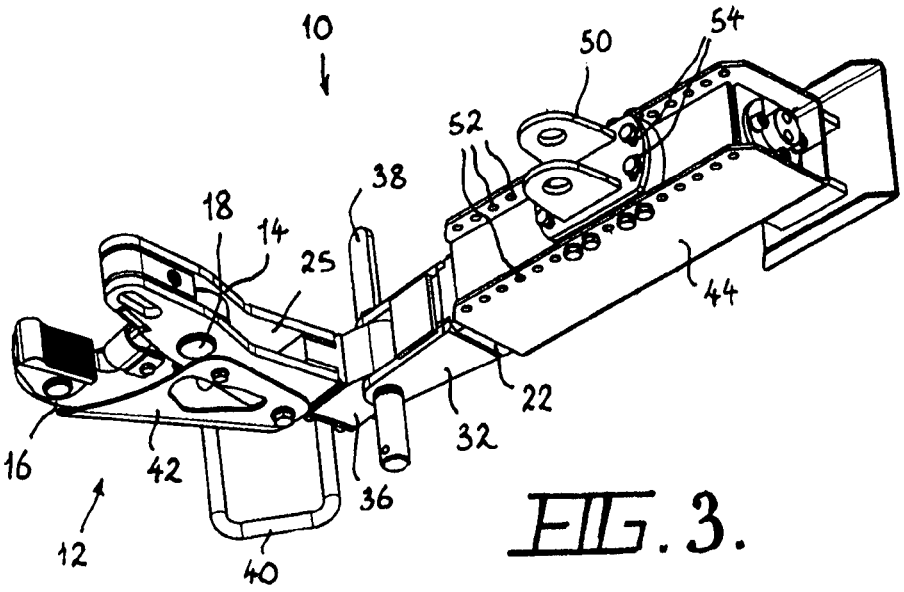

A preferred embodiment of a breakout tool 10 in accordance with the invention, as illustrated in FIGS. 1 to 3, comprises a breakout tong 12 adapted to grip a first one of the two components of a drill string (not shown). The breakout tool 10 can be used for "breaking out" the two components of a drill string whilst a second one of the two components is held stationary. The breakout tong 12 comprises a first jaw 14 and a second jaw 16, with the second jaw 16 pivotally coupled to the first jaw 14 at a first pivot point 18. A small hydraulic cylinder 20 is provided in the breakout tong 12 for forcing the second jaw 16 to pivot about the first pivot point 18 when it is activated wherein, in use, the first drill string component can be gripped between the second jaw 16 and the first jaw 14.

The breakout tool 10 further comprises a main hydraulic cylinder 22 adapted to be mounted on the drill rig, (not shown) and which is mechanically coupled to the breakout tong 12 for applying a torque to the breakout tong 12. In use, the two components of the drill string can be broken apart by the breakout tong 12 gripping the first drill string component and applying a torque thereto via the main hydraulic cylinder 22.

Preferably the small hydraulic cylinder 20 has one end pivotally attached to the first jaw 14 and the other end pivotally attached to the second jaw 16 at a second pivot point 24 located a predetermined distance from the first pivot point 18. The distance between the first and second pivot points 18 and 24 is selected to provide a required leverage when forcing the second jaw 16 to pivot about the first pivot point 18. As can be seen most clearly in FIGS. 1 and 2 the second jaw 16 is hook-shaped. On the other hand the first jaw 14 is substantially straight and is joined at an elbow to an arm 25 forming part of the breakout tong 12.

The first jaw 14 is preferably provided with a serrated insert 26 to help grip the drill string component, and the second jaw 16 is preferably provided with a jaw tip 28 having a serrated surface to also help grip the drill string component. The jaw tip 28 is preferably attached to the second jaw 16 via pivot pin 30 to allow for easy removal. Advantageously the geometry of the second jaw 16 relative to the first jaw 14 of the breakout tong 12 is such that, once the second jaw 16 begins to grip the first drill string component, the greater the torque applied to the breakout tong 12 the tighter the second jaw 16 will grip the first drill string component.

Preferably the breakout tong 12 is pivotally coupled to the main hydraulic cylinder 22 via a first mounting clevis 32. The first mounting clevis 32 is fixed to one end of the hydraulic cylinder 22 and has a pivot pin 34 provided in connection therewith, the pivot pin 34 also passing through a mounting block 36 provided in connection with the first jaw 14 of the breakout tong 12. Advantageously the mounting block is a swivel block 36 which is adapted to permit the breakout tong 12 to swivel though at least 180° about a longitudinal axis of the arm 25 of the breakout tong.

The arm 25 has a boss (not visible) which is pivotally mounted in a bore provided through the swivel block 36. A first handle 38 is attached to an exposed face of the boss, at the back end of the swivel block 36, for allowing the arm 25 to be manually pivoted in the swivel block. Handle 38 also acts to retain the arm 25 in the swivel block. As will be described further below, the orientation of the breakout tong 12 can thus be changed to apply a torque to a component of the drill string in the opposite direction (in a makeup mode). A second handle 40 is attached to the side of the swivel block 36 to enable the whole breakout unit 10 to be maneuvered into position.

Preferably the breakout tool 10 further comprises a plurality of hydraulic control valves (not visible) for controlling the sequence of actuation of the small hydraulic cylinder 20 and the main hydraulic cylinder 22. The plurality of hydraulic control valves typically comprises a small directional hydraulic valve and two sequence valves for ensuring the breakout tong 12 grips before a torque is applied thereto, and releases before resetting in both a breakout mode and a makeup mode. A guard 42 covers the moving parts and pinch points of the breakout tongs 12 and prevents stray objects from getting in and jamming the jaws of the breakout tongs or damaging the small hydraulic cylinder 20.

Preferably the main hydraulic cylinder 22 is housed within an elongate square section housing 44 which is attached to the first mounting clevis 32. The rod end of the cylinder 22 is attached to the closed end of the housing 44, and the body of hydraulic cylinder 22 is encased in a square section which enables it to slide longitudinally within the housing 44 but without allowing any axial rotation. The mounting clevis 32 is attached to the end of the hydraulic cylinder 22 and is limited to 90° rotation about the cylinder axis, so as to support the breakout tong 12 in the working position.

A second mounting clevis 50 is provided in connection with the housing 44. The position of the mounting clevis 50 along the housing 44 can be adjusted via a series of mounting holes 52 to allow for different mounting options, as can be seen most clearly in FIG. 3. The mounting clevis 50 can also be pivoted a small amount in either direction on slots 54. This is to allow adjustment of the angle of the complete tong assembly. A cover protects the small directional valve and sequence valves.

A preferred method of "breaking out" two components of a drill string using the breakout tool 10 will now be described with reference to the drawings.

The method comprises the step of gripping a first one of the two components of the drill string with the breakout tong 12 whilst the second one of the two components is held stationary. The step of gripping the first drill string component involves extending the main hydraulic cylinder to its maximum reach. The directional valve is set to retract the small cylinder 20 (opening the second jaw 16) before the main cylinder extends.

The breakout tong 12 is then positioned onto the drill string component above the joint to be broken, and with the drill string in the "mouth" formed between the second jaw 16 and the first jaw 14 on arm 25. The main hydraulic cylinder 22 is then activated to retract. The sequence valves will first activate the small cylinder 20 to close the second jaw 16, which will initiate a grip on the drill string component. The main cylinder 22 then retracts, applying a torque to the breakout tong via mounting clevis 32 and swivel block 36. This turns the breakout tong 12, applying a torque to the drill string component, and consequently breaking the joint.

If there is a requirement to "make up" a joint, or to hold a component from backwards rotation, then the tong 12 can be reversed by rotating the first handle 38 which inverts the tong to the position shown in FIG. 2. The small directional hydraulic valve is then changed to its opposite setting, which changes the sequence to now close the second jaw 16 when the main cylinder 22 is extended.

Advantageously the sequence of activating the small hydraulic cylinder for gripping the first drill string component and of activating the main hydraulic cylinder for applying a torque to the breakout tong is controlled via the hydraulic control valves so that, in use, only a single hydraulic control signal is required to complete all phases of the breakout process.

Now that a preferred embodiment of the breakout tool and a method of "breaking out" two components of a drill string have been described in detail, it will be apparent that the described embodiment provides a number of advantages over the prior art, including the following:

(i) The breakout tool is self supporting and does not require manual intervention during the breakout phase. It is essentially hands-free other than initial location onto drill string.

(ii) It is capable of self adjusting to different drill string sizes.

(iii) It is self closing onto the drill string, provides a positive grip and is self-tightening on the drill string.

(iv) It is capable of left hand or right hand mounting, and has adjustable mounting positions.

(v) It is relatively light weight.

It will be readily apparent to persons skilled in the relevant arts that various modifications and improvements may be made to the foregoing embodiments, in addition to those already described, without departing from the basic inventive concepts of the present invention. For example, the shape and configuration of the first and second jaws of the tong may be quite different from that illustrated. Therefore, it will be appreciated that the scope of the invention is not limited to the specific embodiments described.

The invention claimed is:

1. A breakout tool for breaking out two components of a drill string on a drill rig, the tool comprising:

a breakout tong configured to grip a first one of the two components of the drill string while a second one of the two components is held stationary, the breakout tong including a first jaw and a second jaw, the second jaw being pivotally coupled to the first jaw at a first pivot point and having a small hydraulic cylinder for forcing the second jaw to pivot about the first pivot point when it is activated, wherein a geometry of the second jaw relative to the first jaw of the breakout tong is configured such that, as the first jaw grips the drill string component, applying greater torque to the breakout tong causes the second jaw to tighten the grip on the first drill string component and wherein, in use, the first drill string component can be gripped between the second jaw and the first jaw; and a main hydraulic cylinder configured to be mounted on the drill rig and being mechanically coupled to the breakout tong to apply a torque to the breakout tong, wherein the breakout tong is pivotally coupled to the main hydraulic cylinder via a first mounting clevis, the first mounting clevis being fixed to one end of the main hydraulic cylinder and having a first pivot pin provided in connection therewith, and wherein, in use, the two components of the drill string can be broken apart by the breakout tong gripping the first drill string component and applying a torque thereto.

2. The breakout tool as defined in claim 1, wherein the small hydraulic cylinder has one end pivotally attached to the first jaw and another end pivotally attached to the second jaw at a second pivot point located a predetermined distance from the first pivot point.

3. The breakout tool as defined in claim 1, wherein the first pivot pin passes through a mounting block provided in connection with the first jaw of the breakout tong.

4. The breakout tool as defined in claim 3, wherein the mounting block is a swivel block which is adapted to permit the breakout tong to swivel through at least 180 degrees.

5. The breakout tool as defined in claim 1 wherein the main hydraulic cylinder is housed within an elongate square section housing.

6. The breakout tool as defined in claim 5, wherein a rod end of the main hydraulic cylinder is attached to a closed end of the housing, and a body of the main hydraulic cylinder is encased in a square section of the housing.

7. The breakout tool as defined in claim 1 wherein the tool further comprises a plurality of hydraulic control valves configured to control a sequence of actuation of the small hydraulic cylinder and the main hydraulic cylinder.

8. The breakout tool as defined in claim 7, wherein the plurality of hydraulic control valves comprises a small directional hydraulic valve and two sequence valves.

9. A breakout tool for breaking out two components of a drill string on a drill rig comprising:

a breakout tong configured to grip a first one of the two components of the drill string while a second one of the two components is held stationary, the breakout tong including a first jaw, a second jaw pivotally coupled to the first jaw at a pivot point, and a first hydraulic cylinder coupled to the second jaw and configured to pivot the second jaw about the pivot point;

a second hydraulic cylinder configured to be mounted to the drill rig, and a mounting clevis pivotally coupling the breakout tong to the second hydraulic cylinder, the mounting clevis including a pivot pin extending there through, and the pivot pin is coupled to the breakout tong through a mounting block fixed to the first jaw.

10. The breakout tool of claim 9 wherein the first hydraulic cylinder is smaller than the first hydraulic cylinder.

11. The breakout tool of claim 9 wherein the first hydraulic cylinder includes one end pivotally attached to the first jaw and another end pivotally attached to the second jaw.

12. The breakout tool of claim 9 wherein the mounting block includes a swivel block.

13. The breakout tool of claim 9 wherein the second hydraulic cylinder is housed within an elongate housing.

14. The breakout tool of claim 9 wherein a first end of the second hydraulic cylinder is attached to a closed end of the housing and an another end of the second hydraulic cylinder extends out of the housing and attaches to the breakout tong.

15. The breakout tool of claim 9 further comprising hydraulic control valves configured to actuate the first and second hydraulic cylinders.

* * * * *